US006477946B1

(12) United States Patent
Ogata

(10) Patent No.: US 6,477,946 B1
(45) Date of Patent: Nov. 12, 2002

(54) STENCIL PRINTING MACHINE

(75) Inventor: Masaharu Ogata, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/659,830

(22) Filed: Sep. 11, 2000

(30) Foreign Application Priority Data

Sep. 17, 1999 (JP) ..... 11-264540

(51) Int. Cl.[7] ..... B41L 13/18
(52) U.S. Cl. ..... 101/119; 101/120
(58) Field of Search ..... 101/116, 119, 101/120

(56) References Cited

U.S. PATENT DOCUMENTS

| | | | | | |
|---|---|---|---|---|---|
| 3,886,861 | A | * | 6/1975 | Anselrode | 101/119 |
| 3,901,146 | A | * | 8/1975 | Stierlein | 101/119 |
| 3,960,076 | A | * | 6/1976 | Wick | 101/119 |
| 4,077,320 | A | * | 3/1978 | Weber et al. | 101/119 |
| 5,081,924 | A | * | 1/1992 | Ohinata | 101/120 |
| 5,247,882 | A | * | 9/1993 | Zook et al. | 101/120 |
| 6,247,401 | B1 | * | 6/2001 | Sato et al. | 101/120 |
| 6,263,296 | B1 | * | 7/2001 | Nakamura | 101/119 |
| 6,311,614 | B1 | * | 11/2001 | Ogata et al. | 101/119 |

FOREIGN PATENT DOCUMENTS

| | | | |
|---|---|---|---|
| JP | 61-188180 | * | 8/1986 |
| JP | 10100528 | | 4/1998 |

* cited by examiner

*Primary Examiner*—Stephen R. Funk
(74) *Attorney, Agent, or Firm*—Gary M. Nath; Harold L. Novick; Marvin C. Berkowitz

(57) ABSTRACT

A stencil printing machine of the present invention has an inner press roller (47) arranged in the inside of a printing drum (16), an inner press mechanism (20) for shifting the inner press roller (47) between a pressure position (B) and a standby position and for adjusting a pressure power of the inner press roller (47) at the pressure position (B). At the pressure position (B), the inner press roller (47) presses the inner peripheral surface of a screen (19) forming a peripheral wall of the printing drum (16). At the standby position, the inner press roller (47) is separated from the inner peripheral surface. During printing, the inner press roller (47) is positioned at the pressure position (B) at which the inner press roller (47) presses the inner peripheral surface of the screen (19). The inner press mechanism (20) has an ink supply unit (38) arranged at the inside of the printing drum (16) in order to shift the inner press roller (47) between the pressure position (B) and the standby position. A power transfer section (39) is arranged in the outside of the printing drum (16). The power transfer section (39) transfers the driving power to the ink supply unit (38) in order to shift the inner press roller (47) between the pressure position (B) and the standby position and also in order to adjust the pressure power of the inner press roller (47) at the pressure position (B).

9 Claims, 10 Drawing Sheets

STENCIL PRINTING MACHINE

CROSS-REFERENCE TO RELATED APPLICATION

This application is based upon and claims the benefit of priority from the prior Japanese Patent Application No. 11-264540, filed Sep. 17, 1999; the entire contents of which are incorporated herein by reference.

BACKGROUND OF THE INVENTION

1. Field of the Invention

The present invention relates to a stencil printing machine of an inner pressure type for acting a printing pressure onto the inner peripheral surface of a printing drum.

2. Description of the Related Art

There is a conventional stencil printing machine of the inner pressure type that has been disclosed in the Japanese laid-open publication No. 10-100528, for example.

FIG. 1 is a partially sectional view of the conventional stencil printing machine of the above example. In FIG. 1, the parts of the outer peripheral surfaces of both a printing drum 100 and a pressure roller 101 are rotatably arranged in close proximity to each other. The peripheral surface of the printing drum 100 is made up of a screen. A stencil sheet 103 can be fitted on and removed from the outer peripheral surface of a screen 102.

An inner press roller 104 is arranged or placed in the printing drum 100 so that the inner press roller 104 is rotatable around a lever 106 that is supported around the center of a supporting shaft 105. The inner press roller 104 is moved between the standby position and the pressure position A. The standby position is separated in arrangement from the inner peripheral surface of the screen 102. At the pressure position A, the inner press roller 104 presses the inner peripheral surface of the screen 102. An inner press mechanism 107 is arranged in the printing drum 100.

The inner press mechanism 107 comprises an inner press roller shift means 108 and a pressure adjustment means 109 for the inner press roller 104. The inner press roller shift means 108 provides a driving power to the lever 106 so that the inner press roller 104 can be shifted between the standby position and the pressure position A. The pressure adjustment means 109 for the inner press roller 104 can adjust the pressure power of the inner press roller 104 at the pressure position A.

The inner press roller shift means 108 has a shifting motor 110 whose rotation shaft is fixed to a first gear 111. This first gear 111 is meshed with a second gear 112 correctly. In addition, an eccentric cam 113 is fixed to the second gear 112. The cam surface of the eccentric cam 113 contacts with a cam follower 114 that is supported rotatably by a lever 106. When the shifting motor 110 is rotating, this rotation is transmitted to the eccentric cam 113 through the first and second gears 111 and 112. Then, the lever 106 rotates according to the rotation position of the eccentric cam 113, so that the inner press roller 104 is shifted between the standby position and the pressure position A shown in FIG.1.

The pressure adjustment means 109 for the inner press roller 104 has the adjustment motor 115 whose rotation shaft is fixed to a third gear 116. The third gear 116 and a fourth gear 117 are meshed. A nut member 118 is fixed to this fourth gear 117. A screw rod 119 is inserted to the threaded hole of this nut member 118, and one end of a screw rod 119 is connected to one end of a spring 121 through an arm member 120.

Other end of this spring 121 is connected to the lever 106 and the inner press roller 104 may press the screen 102 by the pressure of the spring 121. When the adjustment motor 115 rotates, this rotation is transmitted to the screw rod 119 in order to rotate the screw rod 119 through the third gear 116, the fourth gear 117, and the nut member 118. The screw rod 119 is thereby shifted toward the shaft direction thereof and a stroke of the spring 121 is changed in order to adjust the pressure power of the inner press roller 104.

Next, a description will be given to an outline of the operation of the conventional stencil printing machine.

After perforations for printing a desired image pattern are made on the stencil sheet 103, the perforated stencil sheet 103 (hereinafter, also referred to as the stencil sheet) is set up on the peripheral surface of the screen 102 forming the wall of the printing drum 100 by clamping the leading edge of the stencil sheet 103.

Next, the inner press roller 104 is shifted to the pressure position A from the standby position by the inner press roller shiftmeans 108 and then both the printing drum 100 and the pressure roller 101 rotate simultaneously. Then, the inner press roller 104 presses the screen 102, and in this state, the inner press roller 104 also rotates following the rotation of the printing drum 100. Ink is supplied on the outer peripheral surface of the inner press roller 104. Then, the ink adhered on the outer peripheral surface of the inner press roller 104 is moved onto the screen in turn.

In this situation, as shown in FIG.1, the print paper 122 is fed between the printing drum 100 and the pressure roller 101 and also continuously fed by the rotation of both the printing drum 100 and the pressure roller 101. The print paper 122 between the printing drum 100 and the pressure roller 101 is fed to outside while pressing the print paper 122, the screen 102, and the stencil sheet 103 between the inner press roller 104 and the pressure roller 101.

The ink of the image pattern on the screen 102 is moved (or printed) from the perforations on the stencil sheet 103 onto the print paper 122 according to the stencil pattern on the stencil sheet 103. Because the print concentration on the print paper 122 is proportional to the pressure of the inner press roller 104, the pressure of the inner press roller 104 may be adjusted by the pressure adjustment means 109 for the inner press roller 104 in order to adjust the concentration of the print on the print paper 122.

However, because the inner press mechanism 107 is arranged in the printing drum 100 in the conventional stencil printing machine having the configuration shown in FIG. 1, it is impossible to reduce the diameter of the printing drum 100 as small as possible. That is, for example, although the stencil printing machine of a small size using small-sized print papers can be obtained by reducing the diameter of the printing drum 100, it is impossible to reduce the stencil printing machine having the configuration where the whole body of the inner press mechanism 107 is contained in the printing drum 100.

SUMMARY OF THE INVENTION

In the light of the above mentioned situations, the present invention has been made. An object of the present invention is, with due consideration to the drawbacks of the conventional technique, to provide a stencil printing machine having a small sized configuration by reducing the diameter of a printing drum thereof.

In accordance with a preferred embodiment of the present invention, a stencil printing machine has a printing drum, a pressure drum, a stencil sheet, an inner press roller, and an inner press mechanism. The outer peripheral surfaces of both the printing drum and the pressure drum are close to each other and rotatable independently. The stencil sheet is attached-on and removable from an outer peripheral surface of the printing drum. The inner press roller is arranged in an inner peripheral surface side of the printing drum, and is shifted between a pressure position at which the inner press roller presses the inner peripheral surface of the printing drum, and a standby position at which the inner press roller is separated in position from the inner peripheral surface. The inner press mechanism adjusts a pressure power of the inner press roller at the pressure position and which comprises an ink supply unit and a power transfer means. The ink supply unit is arranged at inside of the printing drum for shifting the inner press roller between the pressure position and the standby position. The power transfer means is arranged at outside of the printing drum, and provides a driving power to the ink supply unit in order to shift the inner press roller between the pressure position and the standby position and in order to adjust the pressure power of the inner press roller at the pressure position. In the stencil printing machine, during printing, both the printing drum and the pressure drum are rotated so that the outer peripheral surfaces, which are close to each other, of both the printing drum and the pressure drum rotate in a same direction, and the stencil printing is performed by pressing a print paper which is fed between the pressure drum and the stencil sheet placed on the surface of the printing drum by the pressure power. Accordingly, the present invention has a feature in which the power transfer means is arranged at the outside of the printing drum, and the ink supply unit is arranged at the inside of the printing drum.

In addition, in the stencil printing machine as another preferred embodiment of the present invention, the power transfer means has a combined power means for receiving the driving power from a single driving power source in order to shift the inner press roller between the pressure position and the standby position and in order to adjust the pressure power of the inner press roller at the pressure position. Accordingly, one driving power source can perform to shift the inner press roller between the standby position and the pressure position and to adjust the pressure of the inner press roller, and a common power transfer system can be used other than the combined power means.

In addition, in the stencil printing machine as another preferred embodiment of the present invention, the combined power source has a link member and a spring for connecting the driving power source with the ink supply unit, and the link member transfers the driving power to the ink supply unit during a shift operation of the inner press roller from the pressure position to the standby position, and the spring transfers the driving power to the ink supply unit during a shift operation of the inner press roller from the standby position to the pressure position. Accordingly, the combined power means can be made by using the link member and the spring.

Furthermore, in the stencil printing machine as another preferred embodiment of the present invention, both the printing drum and the pressure drum has a same diameter.

Moreover, in the stencil printing machine as another preferred embodiment of the present invention, the single driving power source as the power transfer mean made up of a motor.

BRIEF DESCRIPTION OF THE DRAWINGS

These and other objects, features, aspects and advantages of the present invention will become more apparent from the following detailed description of the present invention when taken in conjunction with the accompanying drawings, in which.

DESCRIPTION OF THE PREFERRED EMBODIMENTS

Figure 1:
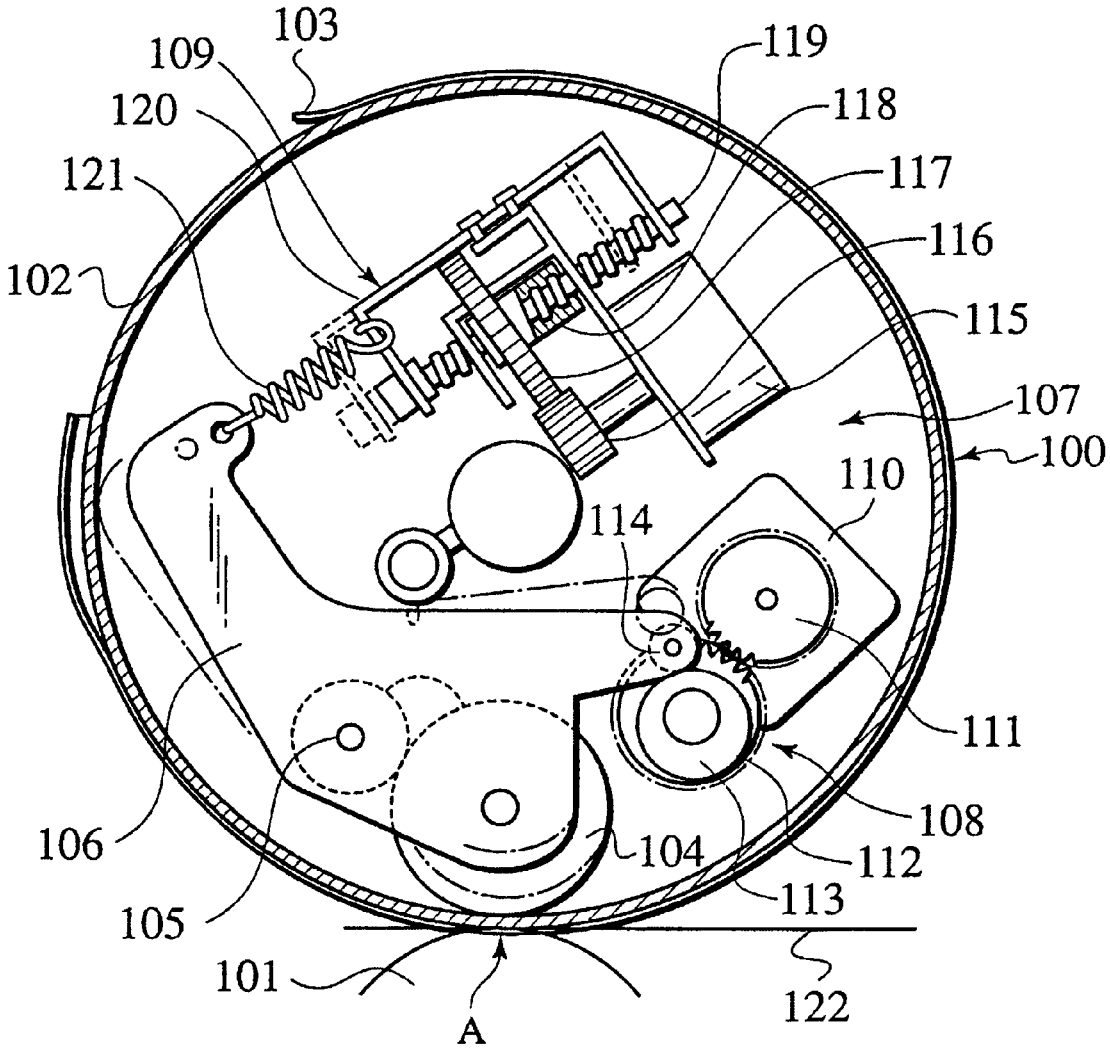
FIG. 1 PRIOR ART
FIG. 1 is a partially sectional view of a conventional stencil printing machine.

Other features of this invention will become apparent through the following description of preferred embodiments that are given for illustration of the invention and are not intended to be limiting thereof.

Referring to the drawings, the following will in detail describe preferred embodiments of the stencil printing machine according to the present invention.

First Embodiment

Figure 2:
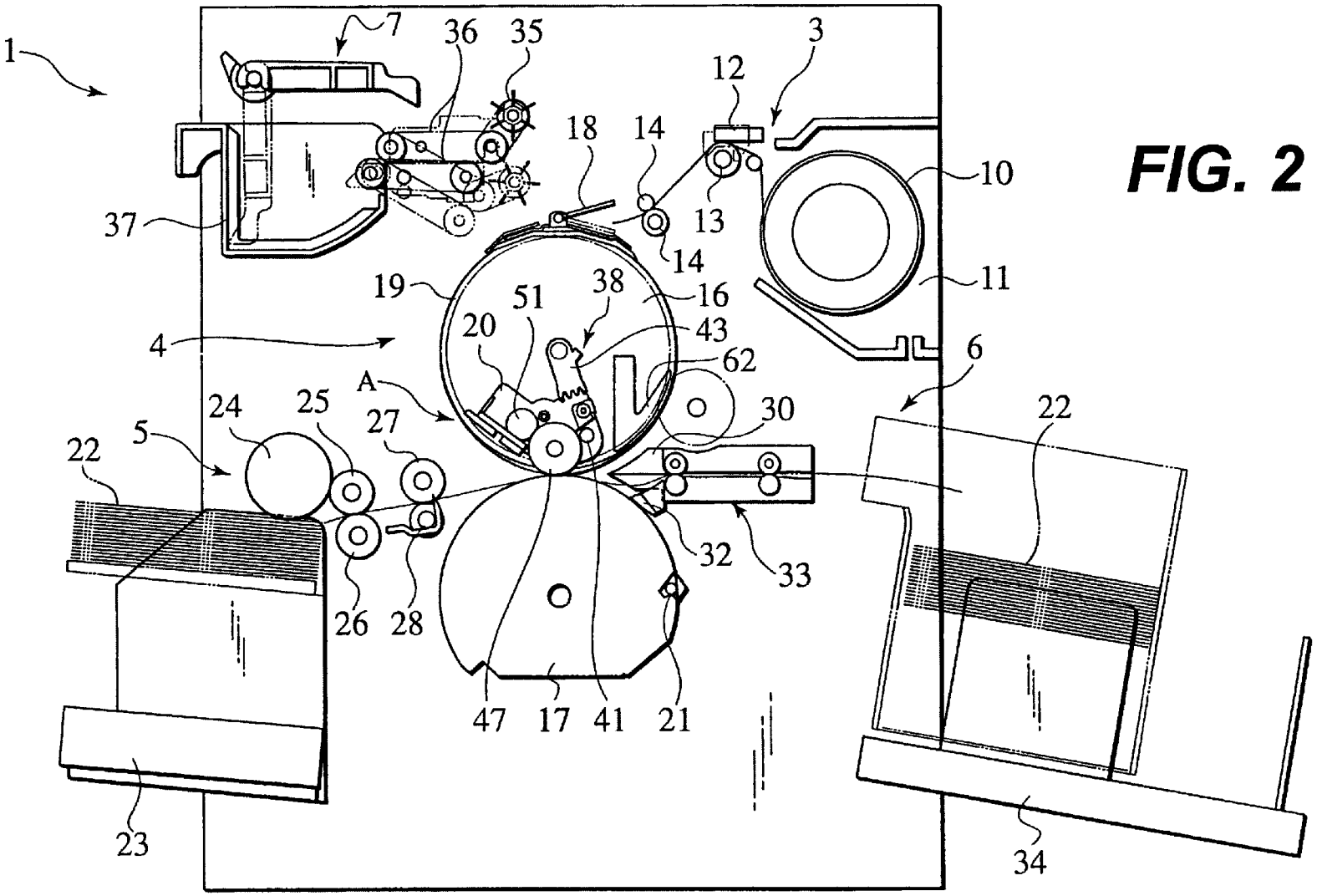
FIG. 2 is a schematic diagram showing a configuration of a stencil printing machine according to a preferred embodiment of the present invention.
Figure 3:
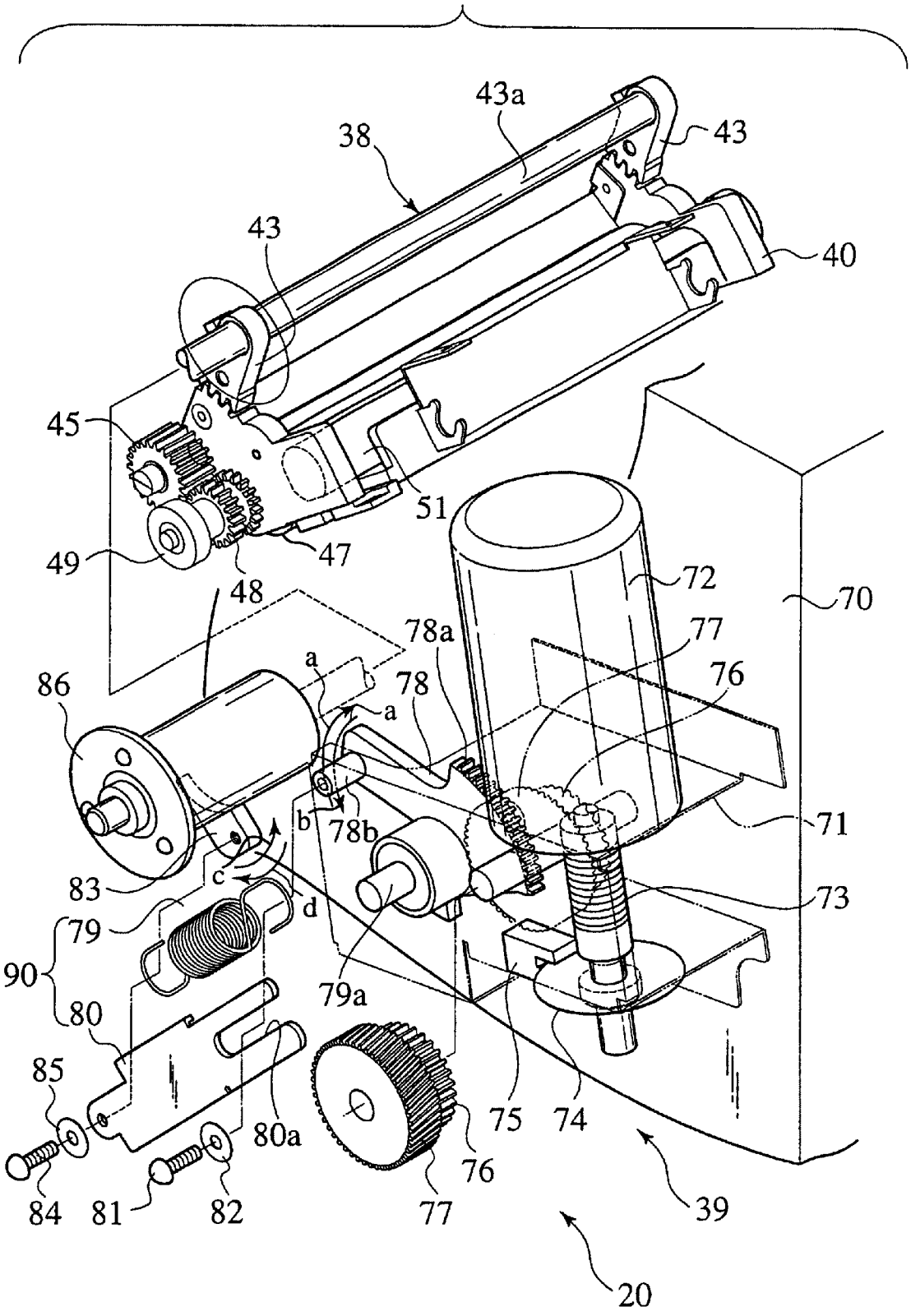
FIG. 3 is a partially perspective diagram showing an inner press mechanism in the stencil printing machine of the preferred embodiment of the present invention.
Figure 4:
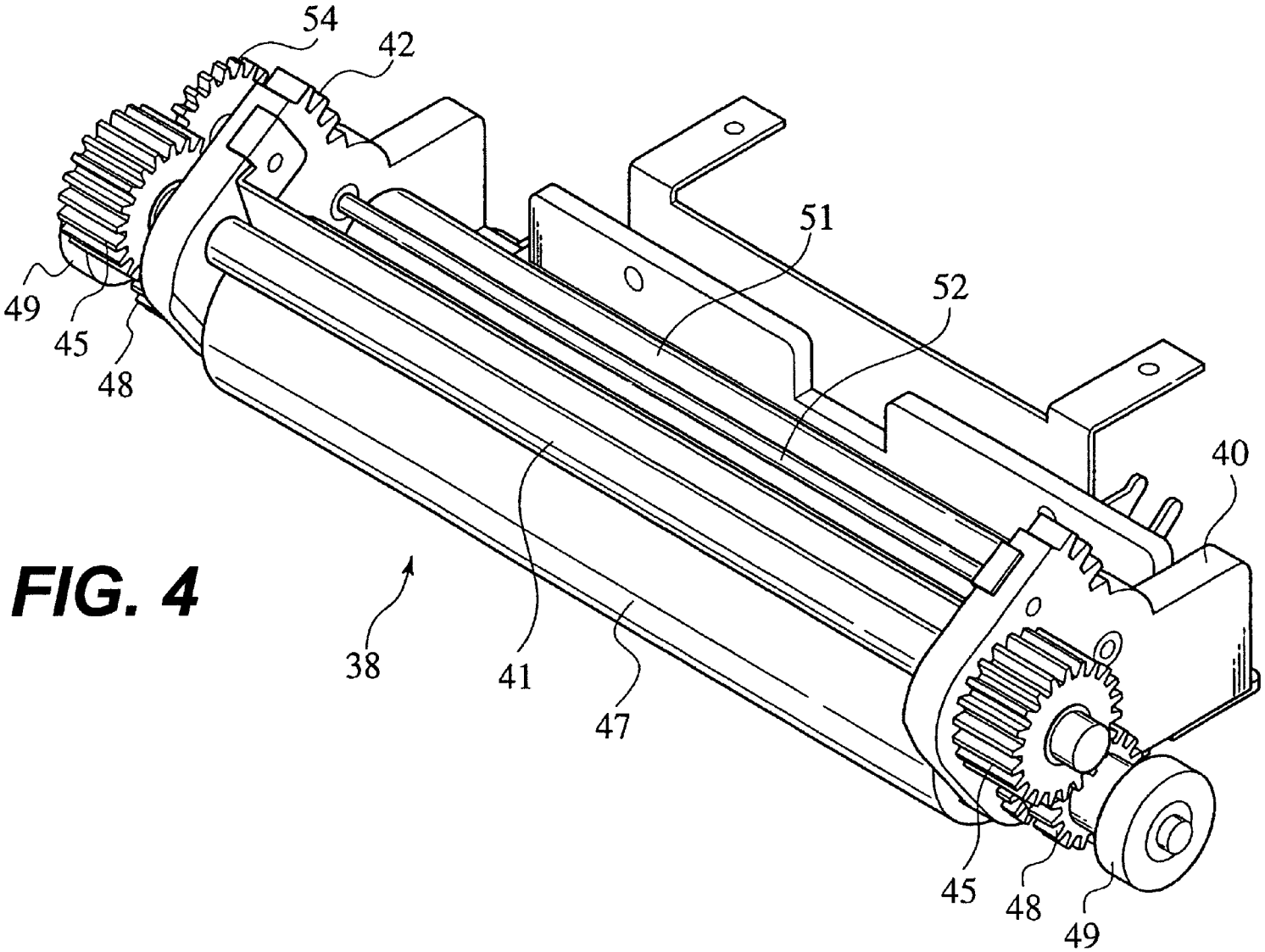
FIG. 4 is a perspective diagram showing an ink supply unit in the stencil printing machine of the preferred embodiment of the present invention.
Figure 5:
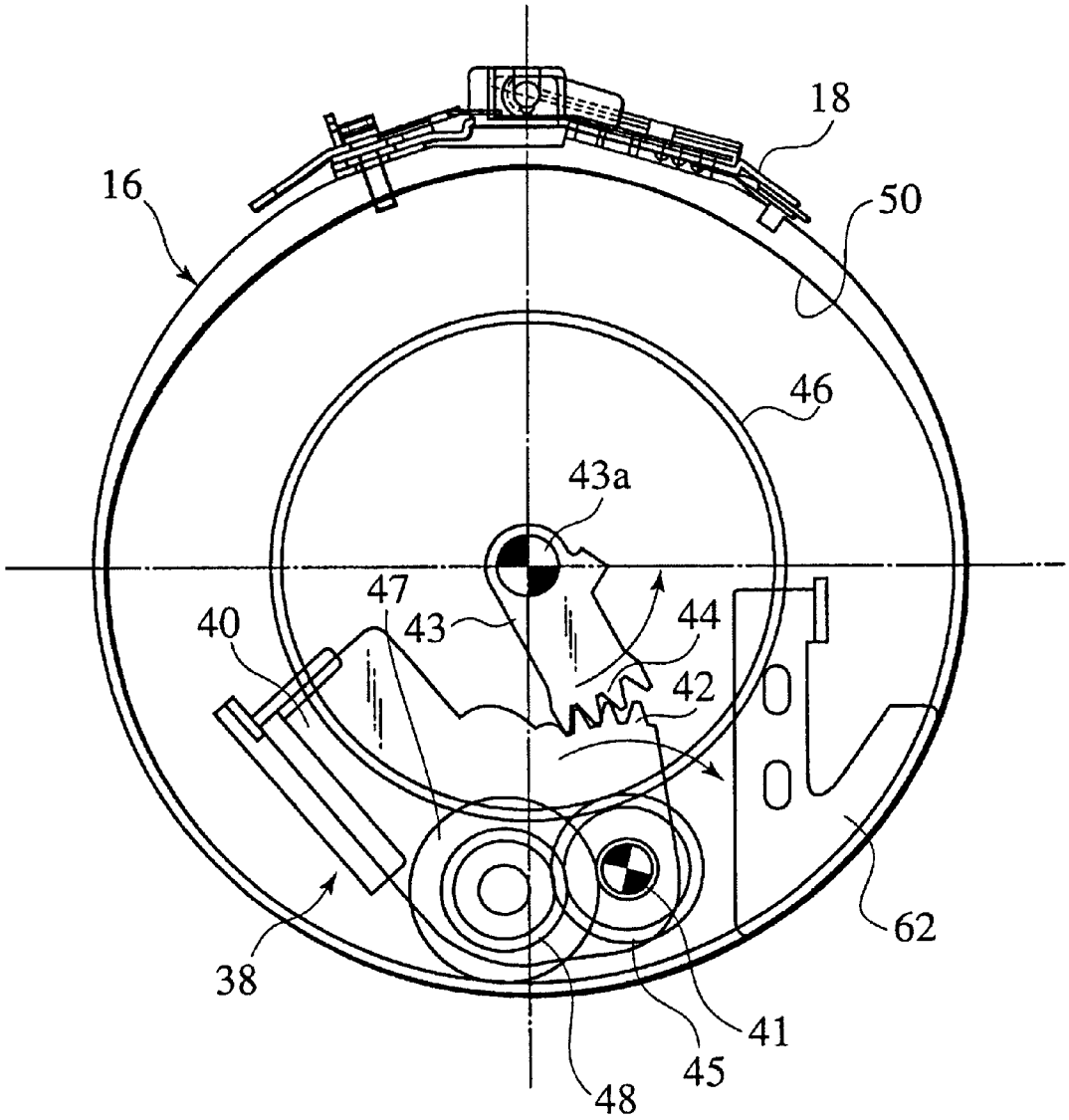
FIG. 5 is a side view showing the configuration of the internal section of a printing drum in which an:inner press roller is positioned at a standby position in the stencil printing machine of the preferred embodiment of the present invention.
Figure 6:
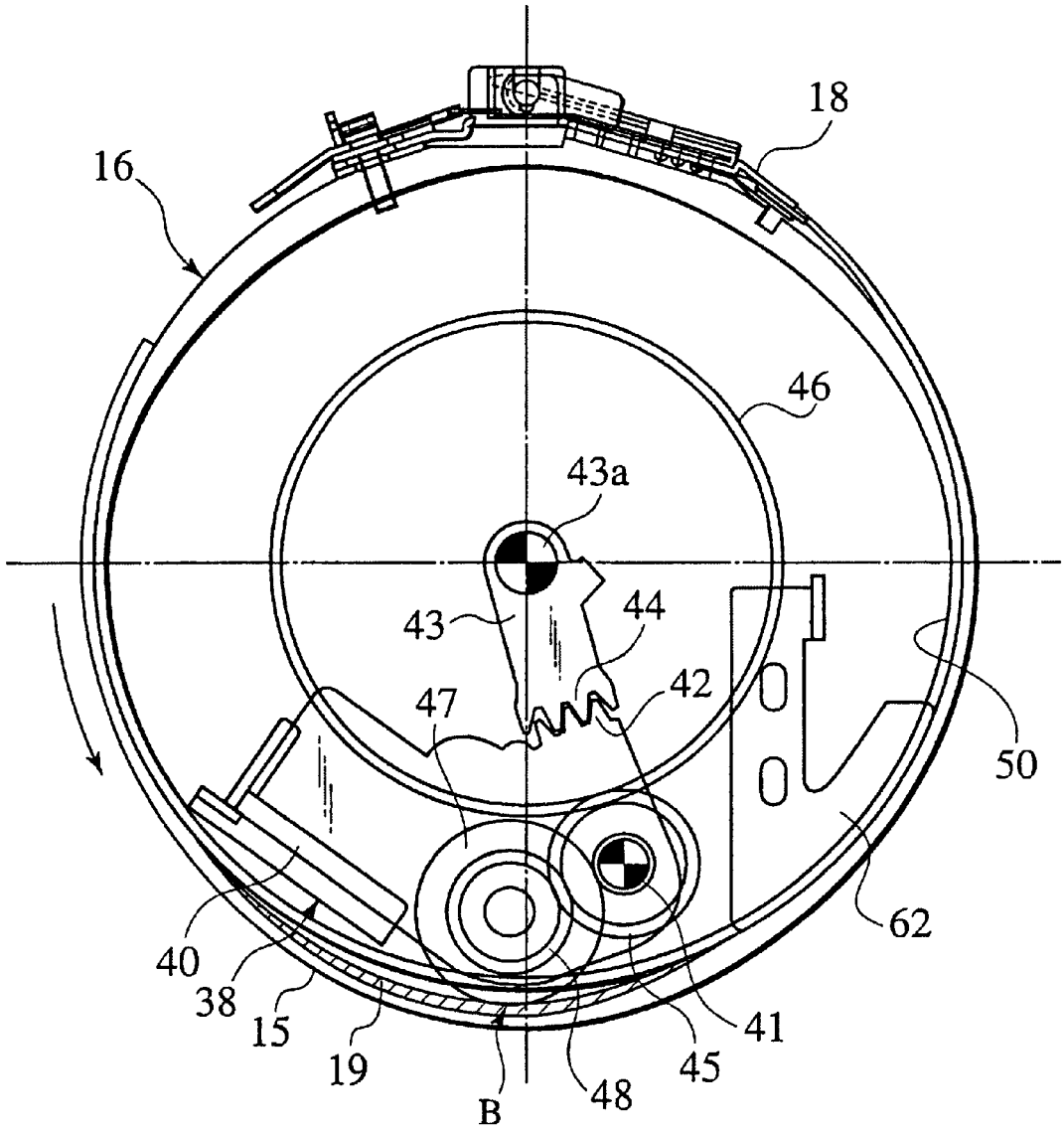
FIG. 6 is a side view showing the configuration of the internal section of the printing drum in which the inner press roller is positioned at a pressure position B in the stencil printing machine of the preferred embodiment of the present invention.
Figure 7:
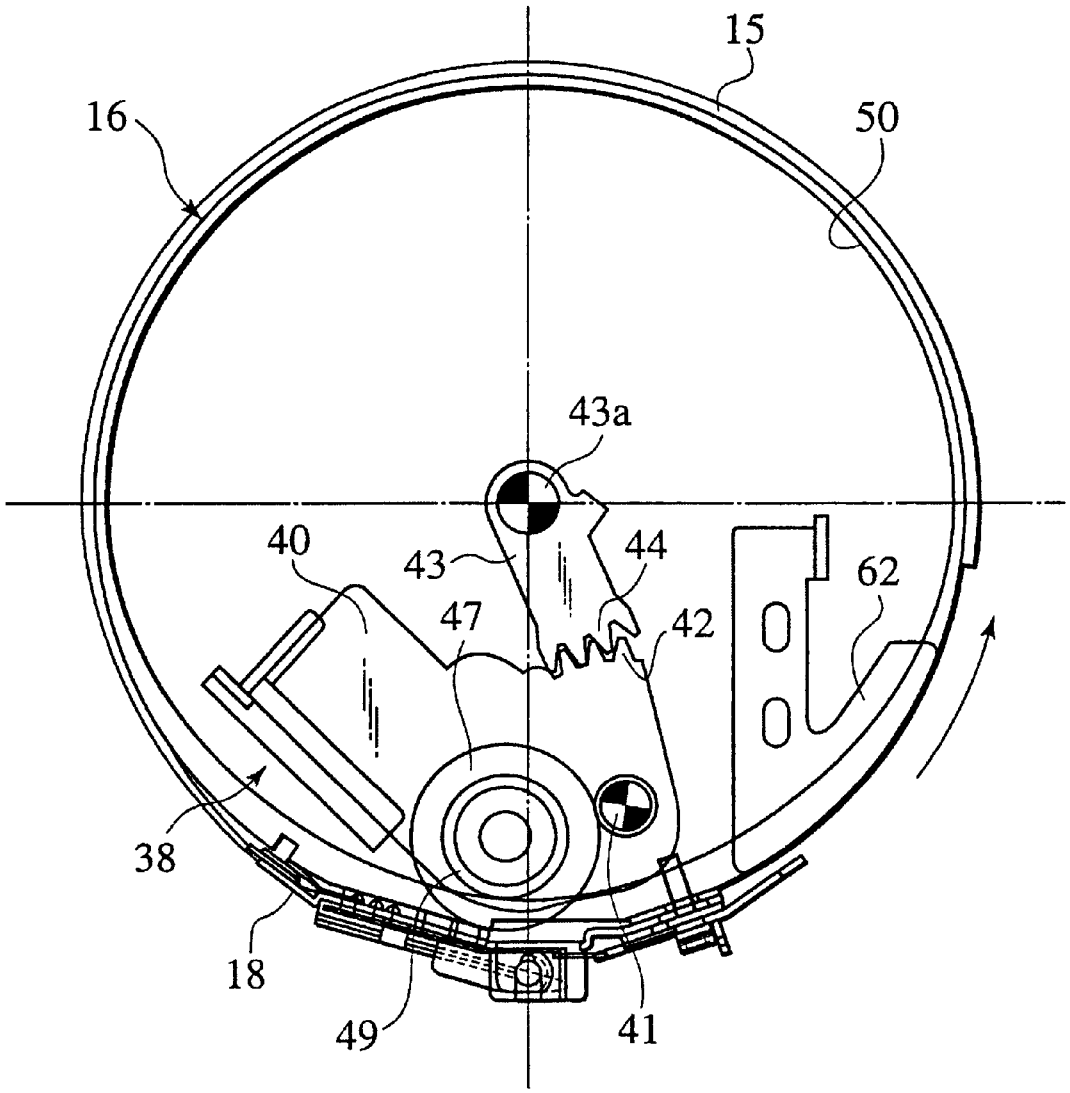
FIG. 7 is a side view showing a configuration of the internal section of the printing drum in a state where the inner press roller is positioned at the pressure position B and the state of a stencil sheet clamp section may be avoided in configuration in the preferred embodiment of the present invention.
Figure 8:
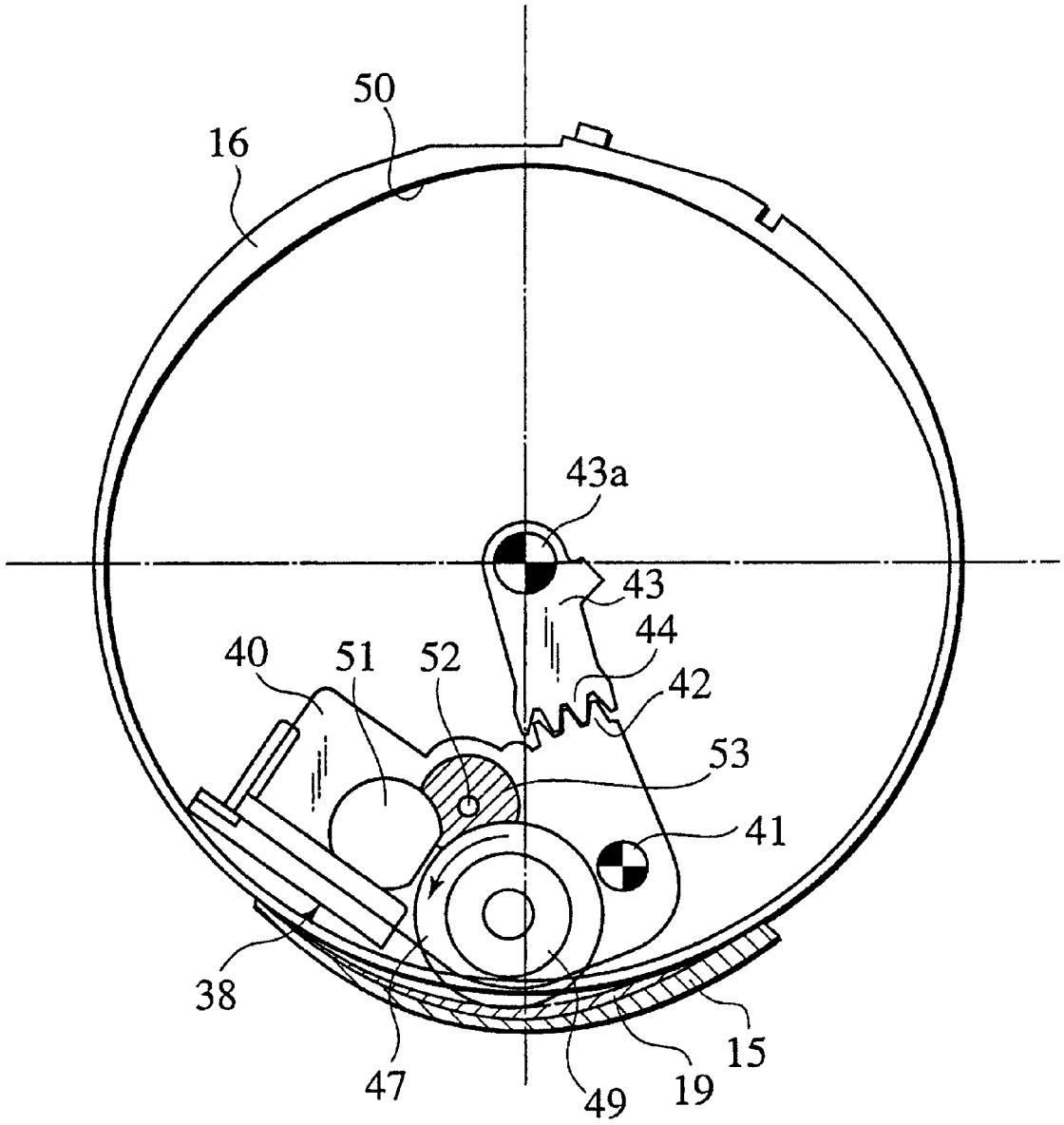
FIG. 8 is a side view showing an ink supply state in the internal section of the printing drum in the stencil printing machine according to the preferred embodiment of the present invention.

FIG. 2 to FIG. 10 are various diagrams and a flowchart of a stencil printing machine 1 according to a preferred embodiment of the present invention. In particularly, FIG. 2 is a schematic diagram showing a configuration of the stencil printing machine 1, FIG. 3 is a partially perspective diagram showing an inner press mechanism 20 in the stencil printing machine, FIG. 4 is a perspective diagram showing an ink supply unit 38 in the stencil printing machine 1, FIG. 5 is a side view showing the configuration of the internal section of a printing drum 16 in which an inner press roller 47 is positioned at a standby position (or a waiting position), FIG. 6 is a side view showing the configuration of the internal section-of the printing drum 16 in which the inner press roller 47 is positioned at a pressure position B, FIG. 7 is a side view showing a configuration of the internal section of the printing drum 16 in a state where the inner press roller 47 is positioned at the pressure position B and a state of a stencil sheet clamp section 18 may be avoided in configuration in the preferred embodiment of the present invention, and FIG. 8 is a side view showing an ink supply state in the internal section of the printing drum 16 in the stencil printing machine 1.

In FIG. 2, the stencil printing machine 1 mainly comprises an original reader section (not shown), a stencil making section 3, a printing section 4, a paper feed section 5, a sheet discharge section 6, and a stencil disposal section 7.

The original reader section (not shown) reads an original as electric signals. These electric signals have a format so that these electric signals can be processed based on specified instructions (enlargement, reduction, and the like).

The stencil making section 3 comprises a stencil sheet container section 11, a thermal head 12, a platen roller 13, a pair of the stencil sheet leading rollers 14, and a stencil sheet cutter (not shown). The stencil sheet container section 11 contains a wound stencil sheet 10 of a long size. The thermal head 12 is arranged at the downstream of the leading direction of the wound stencil sheet 10 of a long size against the stencil sheet container section 11.

The platen roller 13 rotates by the driving power of a write pulse motor (not shown) arranged at the opposition position of the thermal head 12. The pair of stencil sheet leading rollers 14 are arranged at the downstream of the leading direction of the wound stencil sheet 10 of a long size against the platen roller 13 and the thermal head 12 and rotates by the driving power of the write pulse motor (not shown).

The stencil sheet cutter (not shown) is arranged between one pair of the stencil sheet leading rollers 14, the platen roller 13, and the thermal head 12.

The printing section 4 has the printing drum 16 and a pressure drum 17 that are rotatable, the diameters of which are same, and parts of the outer peripheral surfaces of which are contacted to each other. The printing drum 16 includes a pair of cylindrical flanges (not shown) arranged at a desired interval in opposite position.

The stencil sheet clamp section 18 is arranged at a part of the peripheral surfaces of the flanges in order to clamp the end of the stencil sheet 15. A screen 19 is provided on the outer peripheral surfaces of the flanges other than the part contacted to the stencil sheet clamp section 18. This screen 19 is a flexible sheet and forms the peripheral surface of the printing drum 16. The screen 19 forming the peripheral surface of the printing drum 16 may act so that the ink 53 passes through at least a printing region while the printing pressure is applied.

The inner press roller 47 in the inner press mechanism 20 is arranged in the inner section of the screen 19 in the printing drum 16. The detail of the inner press mechanism will be explained later.

A paper clamp section 21 is arranged at the desired position on the outer peripheral surface of the pressure drum 17 in order to clamp the leading edge of the print paper 22 as a printing medium.

The paper feed section 5 comprises a paper feed tray 23, a scraper 24, a pickup roller 25, a stripper roller 26, a guide roller 27, and a timing roller 28. In the paper feed tray 23, print papers 22 as a printing medium are stacked. The scraper 24 presses the upper part of the stacked print papers 22 in the paper feed tray 23. The pickup roller 25 and the stripper roller 26 are arranged in close position at the downstream section of the scraper 24. The guide roller 27 and the timing roller 28 are arranged in close position at the downstream section of the pickup roller 25 and the stripper roller 26.

Only the print paper 22 of the uppermost position in the paper feed tray 23 may be fed by the rotation of the scraper 24 and by the pickup roller 25 and the stripper roller 26. The print paper 22 is further fed in synchronization with the rotation of the guide roller 27 and the timing roller 28 and also with the pressure drum 17.

The paper delivery section 6 comprises an upper limit guide section 30, a paper peeler hook 32, a paper delivery mechanism 33, and a stacker section 34. The upper limit guide section 30 guides the leading edge of the print paper 22 (or the printed paper) on which the printing has already been completed. The paper peeler hook 32 peels the printed paper away from the pressure drum 17. The paper delivery mechanism guided by the upper limit guide section 30 delivers the printed paper that has been peeled away from the pressure drum 17 by the paper peeler hook 32. The stacker section 34 stacks the printed papers delivered by the paper delivery mechanism 33.

The stencil disposal section 7 comprises a stencil disposal guide belt 35, a pair of stencil convey belts 36, and a stencil disposal box. The stencil disposal guide belt 35 guides the leading edge of the stencil sheet 15 that is away from the stencil sheet clamp section 18. The pair of stencil convey belts 36 conveys the stencil sheet 15 guided by the stencil disposal guide belt 35 while peeling it away from the pressure drum 17. The stencil disposal box 37 stores the stencil sheet 15 conveyed by the pair of stencil convey belts 36.

In FIG. 3 to FIG. 7, the inner press mechanism 20 comprises the ink supply unit 38 and a power transfer means 39.

The ink-supply unit 38 is arranged in the internal section of the printing drum 16. The power transfer means 39 is arranged at the outside of the printing drum 16 and transfers the rotation power to the ink supply unit 38. The ink supply unit 38 has a roll support member 40 that is supported rotatably around a fixed member (not shown) whose center is a support shaft 41. The roll support member 40 has a gear section 42 that is meshed with a gear section 44 of an inner arm section 43. The inner arm section 43 is supported rotatably around the driving shaft 43*a*. The one end of the driving shaft 43*a* is projected to the outside of the printing drum 16. The power of the power transfer means 39 is transferred to the projecting driving shaft 43*a* at the outside of the printing drum 16. When the inner arm section 43 is rotated in a clockwise direction, as shown in FIG. 5 to FIG. 7, the roll support member 40 is rotated in a counterclockwise direction, so that the inner press roller 47 is shifted to a pressure position B (see FIG.6) where the inner press roller 47 presses the screen 19 that forms the peripheral surface of the printing drum 16 toward the outer peripheral surface side of the printing drum 16.

When the inner arm section 43 is rotated in the counterclockwise direction, as shown in FIG. 5 to FIG. 7, the roll support member 40 is rotated in the clockwise direction, so that the inner press roller 47 is shifted to the standby position or the waiting position (see FIG. 5) where the inner press roller 47 does not press the screen 18, namely, it is arranged at the inner section of the printing drum 16.

The gear 45 is supported rotatably around the support shaft 41 and meshed to the inner peripheral surface gear section 46 of the printing drum 16. The inner press roller 47 is supported rotatably around the roll support member 40. The first gear 48 and a roller member 49 are fixed to both the ends of the inner press roller 47, respectively.

The first gear 48 is meshed to the gear 45 of the support shaft 48, and the inner press roller 47 is rotated in synchronization with the rotation of the printing drum 16. The roller member 49 is arranged at a position that is separated from the flange cam surface 50 of the printing drum 16 while the inner press roller 47 is at the standby position.

When the inner press roller 47 is at the pressure position B, the roller member 49 is near to or closely adjacent to the flange cam surface 50 of the printing drum 16. Further, when the inner press roller 47 is lifted up and down in the closely pressed position, the roller member 49 is shifted up and down along the flange cam surface 50.

The flange cam surface 50 includes three dimension ranges: a maximum-diameter dimension range; a minimum-diameter dimension range; and a slope dimension range. The diameter of the flange cam surface 50 from the center of the rotation at the stencil clamp section 18 is so formed within the minimum-diameter dimension range. The roller member 49 in the ink supply unit 38 is connected forcedly to the flange cam surface 50 and controlled in position by the flange cam surface 50. Thereby, the inner press roller 47 is kept at the position where the inner press roller 47 does not interfere with the stencil clamp section 18.

In the area other than the stencil clamps section 18, the roller member 49 in the ink supply unit 38 is separated in position from the flange cam surface 50 in order to return this roller member 49 to the position where the inner press roller 47 presses the screen 19. When the roller member 49 comes near the stencil clamp section 18, the roller member 49 in the ink supply unit 38 is contacted forcedly onto the flange cam surface 50, so that the movement of the roller member 49 is controlled by the flange cam surface 50. Thereby, the inner press roller 47 is gradually separated from the screen 19. That is, the position of the inner press roller 47 can be set to the desired positions such as the press start position at which the screen 19 is pressed and the press release position at which the pressure of the inner press roller 47 is released from the screen 19.

The power transfer means 39 includes a motor 72 as a driving power source that is fixed through a bracket 71 of a fixed member 70 arranged at outside of the printing drum 16, as shown in FIG. 3. A worm gear 73 and a disc 74 for detecting a rotational position are fixed to the rotation shaft of the motor 72.

A detection sensor 75 of a rotation position is closely arranged at the outer peripheral section of the disc 74 for detecting the rotation position. The power of the inner press roller 47, namely, the printing concentration can be controlled based on the detection result of the detection sensor 75 of the rotation position. The details will be described below.

The worm gear 73 is meshed with the worm wheel 77. A flat gear 76 is fixed to the worm wheel 77 in a body. A tooth section 78*a* of the arm member 78 is meshed with the plate gear 76. Thereby, the arm member 78 is supported rotatably around a support shaft 79*a*.

A spring hooking pin 78*b* is fixed to the other end of the arm member 78 that is opposed in position to the tooth section 78*a*. One end of a spring 79 is connected and fixed to this spring hooking pin 78*b*. In addition, the spring hooking pin 78*b* is inserted into a longitudinal slot at one end of a link plate 80 as a link member and the spring hooking pin 78*b* and the link plate 80 are connected by a screw 81 and a washer 82 in order to prevent any occurrence of the separation of them to each other.

The other ends of both the spring 79 and the link plate 80 are connected by an outer arm section 83, a screw 84, and a washer 85. The outer arm section 83 is fixed to the outer peripheral surface of a rotation support member 86. An engaging hole (not shown) for engaging the rotation support member 86 to the driving shaft 43*a* is arranged in the rotation support member 86. The rotation of the rotation support member 86 can be transferred to the driving shaft 43*a* after the driving shaft 43*a* is inserted and fixed in the engaging hole.

When the arm member 78 is rotated in the clockwise direction (see the arrow "a" in FIG. 3) by the driving power of the motor 72, the outer arm section 83 is rotated in the counterclockwise direction (see the arrow "c" in FIG. 3) by the power of the spring 79 and the pressure of the spring 79 is always supplied to the inner press roller 47 at the pressure position B. This pressure means the printing pressure.

When the arm member 78 is rotated in the counterclockwise direction (see the arrow "b" in FIG. 3) by the driving power of the motor 72 and then the spring hook pin 78*b* presses the bottom side of the longitudinal slot 80*a* in the link plate 80, the link plate 80 presses the outer arm section 83 in order to rotate it in the clockwise direction (see the arrow "d" in FIG. 3), and the inner press roller 47 is thereby positioned at the standby position shown in FIG. 5. That is, in the direction to shift the inner press roller 47 from the pressure position B to the standby position, the link plate 80 transfers the driving power. On the other hand, in the direction to shift the inner press roller 47 from the standby position to the pressure position B, the spring 79 transfers the driving power. That is, a combined power means 90 is formed. This combined power means 90 can adjust both the two driving powers: the driving power to shift the inner press roller 47 from the pressure position B to the standby position; and the driving power to shift the inner press roller 47 from the standby position to the pressure position B.

As shown in FIG. 4 and FIG. 8, a doctor roller 51 and a driving rod 52 are arranged in the roll support member 40. The doctor roller 51 is fixed to the roll support member 40 at the position adjacent to the inner press roller 47. The driving rod 52 is supported rotatably around the roll support member 40 and arranged in an upper space made by the outer peripheral surfaces of the inner press roller 47 and the doctor roller 51 adjacent to each other. The ink 53 is supplied to the upper space by an ink supply unit (not shown). A gear 54 is fixed to one end of the driving rod 52. The gear 54 is meshed with a second gear (not shown) of the inner press roller 47. The second gear (not shown) is supported to the shaft of the inner press roller 47 through a one-way clutch (not shown). The driving rod 52 is rotated in synchronization with the rotation of the printing drum 16, like the inner press roller 47 described above.

An ink supply section (not shown) comprising an ink bottle, an ink pump, ink distributor then supplies the ink 53 to the upper space, and a driving rod 52 stirs the ink 53. In addition to this, the ink 53 that has already been adhered on the outer peripheral surface of the inner press roller 47 in the stirred ink is also rotated according to the rotation of the inner press roller 47. A desired amount of the ink can adhere to the inner press roller.47 by passing the ink through a gap between the inner press roller 47 and the doctor roller 51. Because the inner press roller 47 presses the screen 19 at the downstream side of the doctor roller 51, the desired amount of ink 53 is printed to the inner peripheral surface of the screen 19. That is, the inner press roller 47 has both the functions: the function to supply the printing pressure from the inner peripheral surface of the screen 19; and the function to supply the desired amount of ink 53 to the inner peripheral surface of the screen 19.

As shown in FIG. 5 and FIG. 6, a pair of ink eliminating members 62 for eliminating the ink physically are incorporated on either side in the inside of the screen 19 at the downstream side in the rotational range of the screen 19 against in position to the inner press roller 47. The bottom part of each ink eliminating member 62 is connected and pressed to the both ends of the screen 19 by a connecting means such as a spring and is sloped at a desired angle through which the ink in both ends of the screen 19 can be returned to the center part of the screen 19.

Figure 9:
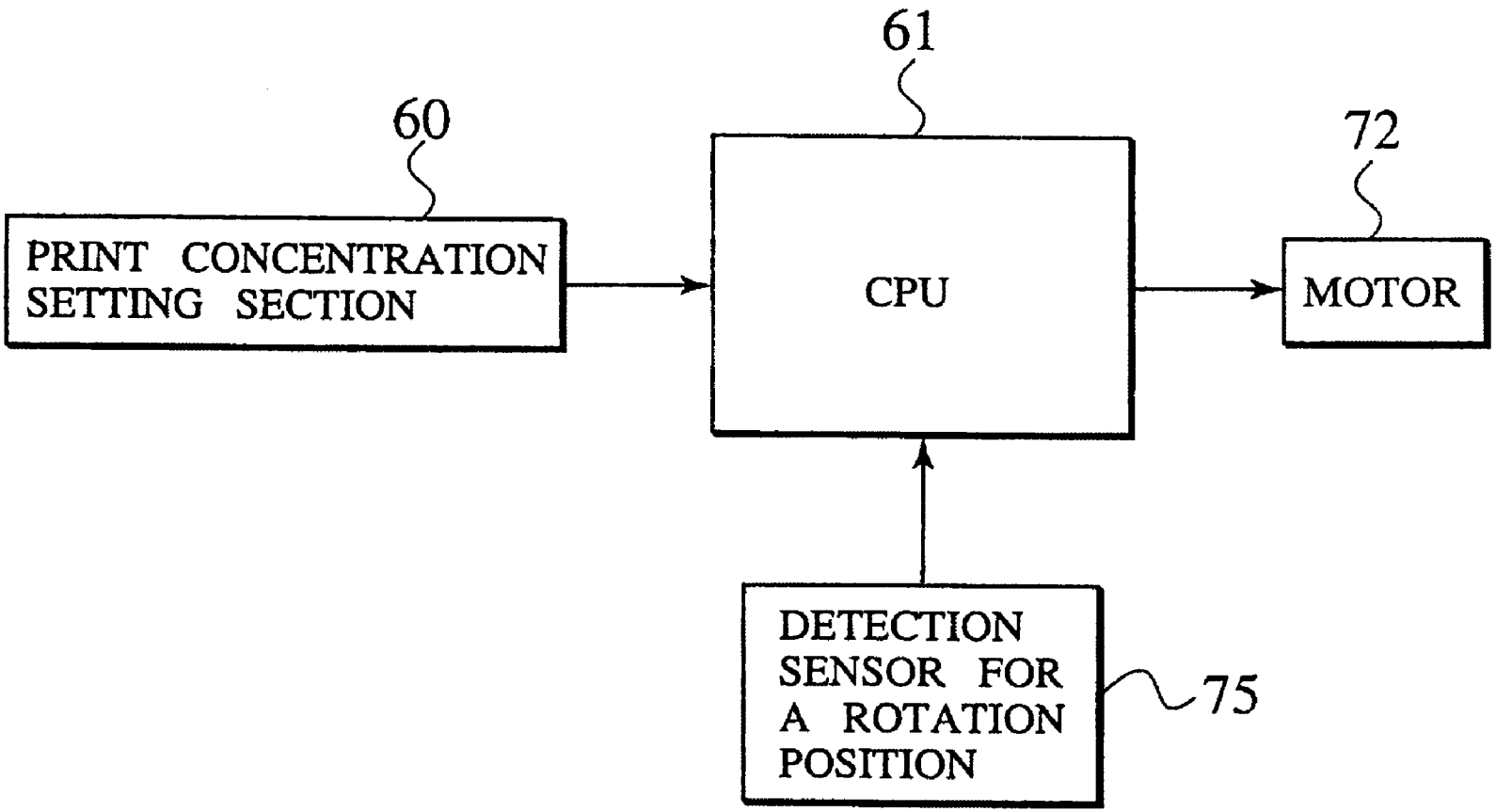
FIG. 9 is a circuit block diagram of the inner press mechanism in the stencil printing machine according to the preferred embodiment of the present invention.
Figure 10:
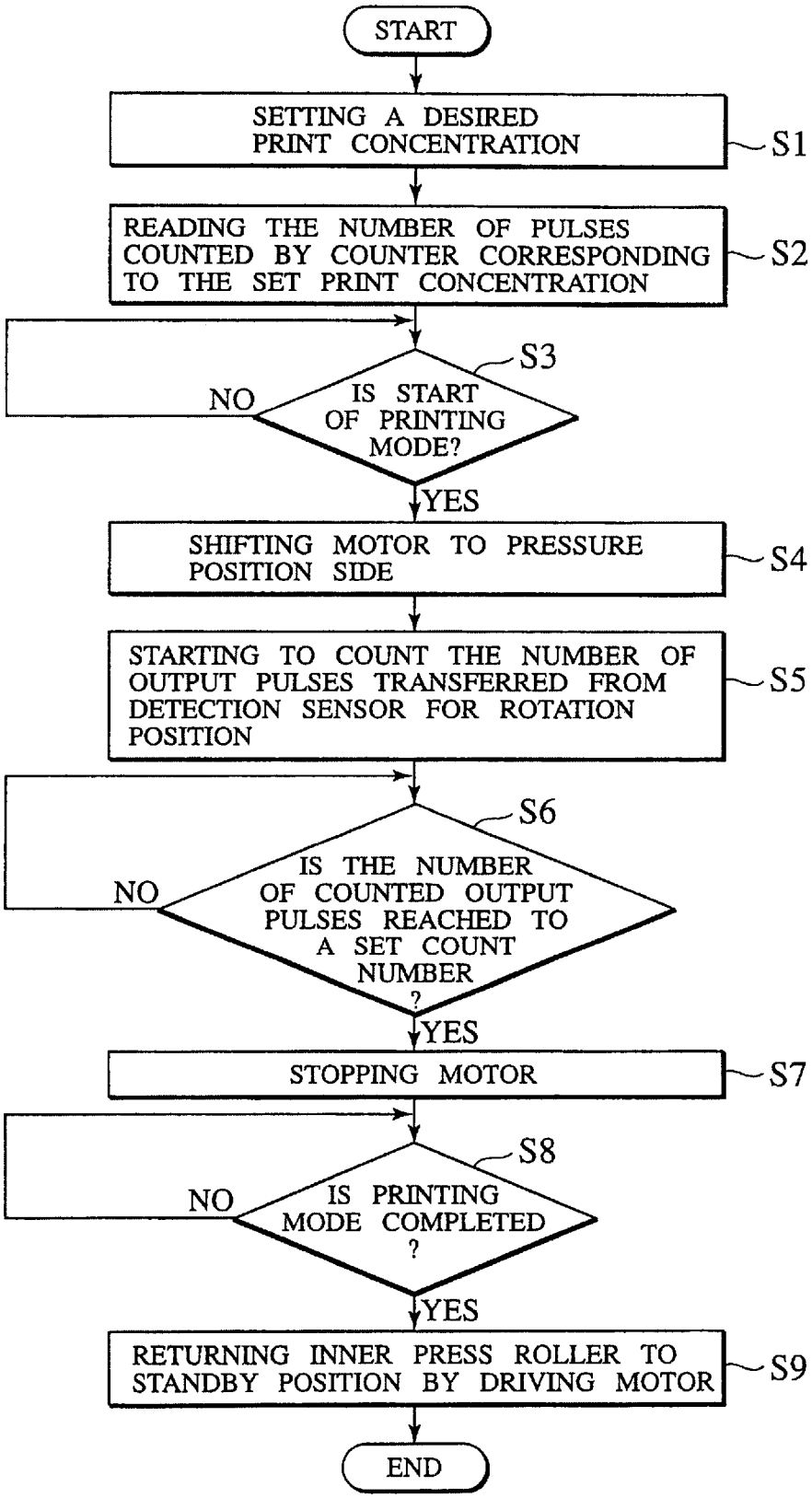
FIG. 10 is a flow chart showing the operation of the inner press mechanism in the stencil printing machine according to the preferred embodiment of the present invention.

FIG. 9 is a circuit block diagram of the inner press mechanism 20 in the stencil printing machine according to the preferred embodiment of the present invention, and FIG. 10 is a flow chart showing the operation of the inner press mechanism 20 in the stencil printing machine.

In FIG. 9, a print concentration set section 60 is arranged at an operation panel (not shown). The operator can set the print concentration data through the print concentration set section 60. The print concentration set section 60 outputs the set data to a central processing unit (CPU) 61. The CPU 61 inputs an output pulse transferred from the detection sensor 75 of a rotation position. This CPU 61 also incorporates a counter for counting the number of the received output pulses. In addition, the CPU 61 incorporates a calculating means for calculating the number of the output. pulses based on the set data set by the print concentration set section 60. That is, the printing concentration is proportional to the pressure of the inner press roller 47 to the screen 19, and the pressure power of the inner press roller 47 depends on the spring force of the spring 79. The spring force of the spring 79 is determined by its own stroke. The stroke of the spring 79 depends on the rotation position of the motor 72. Accordingly, it is possible to control the printing concentration by controlling the rotation position of the motor 72.

As described above, corresponding data items between the printing concentration and the output pulse transferred from the detection sensor 72 of a rotation position is stored in an internal memory, for example, and then the number of pulses to be counted is calculated by reading the number of pulses, from the internal memory, which must be counted corresponding to the set data item.

In addition, the CPU 61 controls the operation of the motor 75 in order to execute the operation flow shown in FIG. 10. The details of the physical control of the motor 75 will be explained below.

Next, a description will be given of the operation of the stencil printing machine 1 having the configuration described above.

In the stencil making section 3, the wound stencil sheet 10 of a long size is lead by the rotation of both the platen roller 13 and the stencil sheet leading rollers 14. Perforations corresponding to image information of an original read by an original reader section (not shown) are selectively selected and then thermally made on the wound stencil sheet 10 of a long size by each heating unit on the thermal head 12. Then, one edition in the wound stencil sheet 10 of a long size is cut by a stencil cutter in order to make the stencil sheet 15.

In the print section 4, the stencil sheet clamp section 18 in the printing drum 16 clamps the leading edge of the stencil sheet 15 made by the stencil making section 3, and while keeping this clamping state, the printing drum 16 is rotated so that the stencil sheet 15 is wound around the outer peripheral surface of the screen 19 forming the peripheral wall of the printing drum 16.

In the paper feed section 5, the print paper 22 is fed in synchronization with the rotation of the printing drum and the pressure drum 17, and the print paper 22 is fed between the printing drum 16 and the pressure drum 17 while clamping the leading edge of the print paper 22 by the paper clamp section 21 in the pressure drum 17.

In the printing section 4, the inner press roller 47 is positioned at the standby position shown in FIG. 5, during not printing, namely, the inner press roller 47 is separated in position from the screen 19. During the printing, the inner press roller 47 is positioned at the pressure position B. This position will be described later in detail.

When the inner press roller 47 is in the printing position, the printing drum 16 is rotated. Thereby, when positioned near the peripheral section of the stencil sheet clamp section 18 other than the avoidance position shown in FIG. 7, the inner press roller 47 rotates on the inner peripheral surface of the screen 19 while pressing the inner peripheral side of the screen 19, as shown in FIG. 6.

Because the ink 53 is supplied onto the entire outer peripheral surface of the inner press roller 47, this ink 53 on the inner press roller 47 is shifted to the screen 19 by this rotation. The screen 19 is expanded to the outer peripheral side by the pressure of the inner press roller 47, and then contacted to the pressure drum 17 under this pressure. Then, the print paper 22 is fed from the paper supply unit 5 to the printing drum 16 and the pressure drum 17 and fed through them while the print paper 22 is pressed by both the screen 19 and the stencil sheet 15. During the pressure feeding process for the print paper 22, the ink 53 corresponding to an image is printed from the perforation in the stencil sheet 15 onto the print paper 22. When fed to the downstream side observed from the position of the inner press roller 47, the leading edge of the print paper 22 is released by the paper clamp section 21.

In the paper delivery section 6, the leading edge of the print paper 22 is guided by the upper limit guide section 30, or the leading edge of the print paper 22 is separated forcedly by the paper peeler hook 32, and then conveyed to the stacker section 34 through the paper delivery mechanism 33.

In the stencil disposal section 7, before a new stencil sheet is made, it must necessary to dispose the stencil sheet 15 to be used in the precious printing wound on the outer peripheral surface of the screen 19 of the printing drum 16. In this case, the stencil sheet clamp section 18 in the printing drum 16 is released at a preceding stage where the new stencil sheet that has been made is loaded and wound at the outer peripheral surface of the printing drum 16, then the end of the released stencil sheet 15 is fed while rotating the printing drum 16 and conveyed through the stencil disposal guide belt 35 by the pair of stencil convey belts 36, and finally stacked into. the stencil disposal box 37.

Next, a description will be given of the operation of the inner press mechanism 20.

As shown in FIG. 10, at the previous stage of the initiation of the printing mode, the operator sets the printings concentration by the print concentration set section 60 (Step S1). Thereby, the CPU 61 reads and then keeps the number of pulses corresponding to the printing concentration to be counted from the internal memory (Step S2). When the printing mode is initiated, the CPU 61 drives the motor 72 (Steps S3 and S4), and starts the counting of the output pulse transferred from the detection sensor 75 for detecting the rotation position (Step S5). When the CPU 61 stops the motor 72 when the counted pulse number is reached to the set count number (Steps S6 and S7).

When the motor 72 rotates, the rotation of this motor 72 is transferred to the ink supply unit 38 through the power transfer means 39, and then the inner press roller 47 is moved from the standby position to the pressure position B and kept at the pressure position B. Because this pressure position B is within a desired stroke of the spring 79, the inner press roller 47, is kept at the pressure position B against the screen 19 while receiving the desired pressure from the spring 79. Because the printing is executed under this pressure condition, it is possible to obtain the desired print concentration that has been set by the operator.

After the completion of the printing mode, the CPU 61 drives the motor 72 in order to return the inner press roller 47 to the standby position (Steps S8 and S9). The printing is thereby completed.

As described above in detail, in the stencil printing machine of the present invention, the power transfer means 39 of the inner press mechanism 20 is arranged or placed in the outside of the. printing drum 16, and only the ink supply unit 38 is thereby, arranged in the inside of the printing drum 16, namely, it is not necessary to keep any space to arrange the power transfer means 39 in the printing drum 16. It is thereby possible to reduce the size -of the stencil printing machine by setting the diameter of the printing drum 16 as small as possible. That is, in the stencil printing machine handling the print paper 22 of a small size, it-is possible to provide the stencil printing machine of a small size because the diameter of the printing drum can be reduced according to the size of the print paper 22.

In particularly, like the preferred embodiment of the present invention described above, in the stencil printing machine in which both the printing drum 16 and the pressure drum 17 have the same diameter, both the printing drum 16 and the pressure drum 17 are made in a small size. This can reduce the size of the stencil printing machine.

In addition, in the inner press mechanism 20 in the stencil printing machine according to the preferred embodiment described above, only one motor 72 controls both the operations: to shift the inner press roller 47 between the standby position and the pressure position; and to adjust the pressure power of the inner press roller 47. Furthermore, in the inner press mechanism 20, a common power transfer system is used other than the combined power means 90. Accordingly, it is possible to reduce the configuration of the stencil printing machine and to make the stencil printing machine with a low cost because the number of power sources can be reduced and common structure parts can be used.

Furthermore, in the power transfer means 39 in the stencil printing machine according to the preferred embodiment described above, because the combined power means 90 is made up of the link plate 80 and the spring 79, it is possible to make the combined power means 90 with a simple configuration. This causes to further reduce the entire configuration of the stencil printing machine and also the manufacturing cost thereof.

In addition, the power transfer means 39 in the inner press mechanism 20 comprises the motor 72, the worm gear 73, the worm 30 wheel 77, the flat gear 76, the arm member 78, the spring 79, the link plate 80, and the rotation support member 86. However, the present invention is not limited by this configuration, for example, it is possible to use any means capable of transferring a desired power to the ink supply unit 38.

By the way, the preferred embodiment described above has shown the case where the pressure adjustment of the inner press roller 47 is also used for the adjustment of the print concentration to be set by the user. However, the present invention is not limited by this embodiment, for example, it is possible that the pressure adjustment for the inner press roller 47 is also used to shift the amount of the ink from the stencil sheet 15 onto the print paper 22 at a constant rate. That is, since the amount of the ink to be shifted is fluctuated according to an ambient temperature, a leaving time (namely, a time from a previous printing to a current printing), a printing speed, a wide of the print paper 22, a property of the print paper 22, an image rate, and the like, it is possible to control the pressure adjustment of the inner press roller 47 in order to set the amount of the ink to be shifted at a constant amount by detecting one, or more, or all of the above conditions.

As set forth, according to the stencil printing machine of the present invention, the inner press roller is arranged in the inside of the printing drum. and the inner press. mechanism is also arranged so that the inner press roller can be shifted between the pressure position and the standby position and the pressure power of the inner press roller at the pressure position can be adjusted. That is, at the pressure position, the inner press roller presses the inner peripheral surface of the printing drum, and the standby position is separated in position from the inner peripheral surface. The stencil printing machine performs the printing process of a pressure type in which a print paper is pressed between the pressure drum and the stencil sheet that is set on the peripheral surface of the printing drum while the inner press roller presses the inner peripheral surface of the printing drum at the pressure position.

In particularly, the inner press mechanism has the ink supply unit and the power transfer means, the ink supply unit is arranged at the inside of the printing drum for shifting the inner press roller between the pressure position and the standby position. On the other hand, the power transfer means is arranged at the outside of the printing drum, and which provides a driving power to the ink supply unit in order to shift the inner press roller between the pressure position and the standby position, and which also adjusts the pressure power of the inner press roller at the pressure position. Thereby, because the power transfer means in the inner press mechanism is arranged at the outside of the printing drum, and because the ink supply unit is arranged at the inside of the printing drum, it is possible to reduce the diameter of the printing drum as small as possible when compared with conventional stencil printing machines. This can also reduce the entire size of the stencil printing machine.

In addition, according to the stencil printing machine of the present invention, the power transfer means has the combined power means for receiving the driving power from a single driving power source in order to shift the inner press roller between the pressure position and the standby position and in order to adjust the pressure power of the inner press roller at the pressure position. Thereby, in addition to the effect of the present invention described above, it is possible to perform both the shifting of the inner press roller between the standby position and the pressure position and the adjusting of the pressure of the inner press roller only by one driving power source. and a common power transfer system is used other than the combined power source. It is thereby possible to reduce the number of the driving power sources and the number of the configuration parts. This can provide the stencil printing machine of a compacted type and reduce the manufacture costs thereof.

In addition, the combined power means in the stencil printing machine of the present invention has the link member and the spring for connecting the driving power source side with the ink supply unit, and the link member transfers the driving power to the ink supply unit during the shift operation of the inner press roller from the pressure position to the standby position, and the spring transfers the driving power to the ink supply unit during the shift operation of the inner press roller from the standby position to the pressure position. Accordingly, in addition to the featured of the present invention described above, it is possible to provide the stencil printing machine with a simple and compacted configuration and thereby to reduce the manufacturing cost because the combined power means is made up of the two configuration parts, the link member and the spring.

While the above provides a full and complete disclosure of the preferred embodiments of the present invention, various modifications, alternate constructions and equivalents may be employed without departing from the scope of the invention. Therefore the above description and illustration should not be construed as limiting the scope of the invention, which is defined by the appended claims.

What is claimed is:

1. A stencil printing machine comprising:

a printing drum and a pressure drum whose outer peripheral surfaces are close to each other and which are rotatable independently;

a stencil sheet attached on and removable from the outer peripheral surface of said printing drum;

an inner press roller arranged in an inner peripheral surface side of said printing drum, and which is shifted between a pressure position at which said inner press roller presses said inner peripheral surface of said printing drum, and a standby position at which said inner press roller is separated in position from said inner peripheral surface; and an inner press mechanism for adjusting a pressure power of said inner press roller at said pressure position, which comprises:

an ink supply unit arranged at inside of said printing drum for shifting said inner press roller between said pressure position and said standby position; and power transfer means arranged at outside of said printing drum, and for providing a driving power to said ink supply unit in order to shift said inner press roller between said pressure position and said standby position, and in order to adjust said pressure power of said inner press roller at said pressure position, wherein during printing, both said printing drum and said pressure drum are rotated so that said outer peripheral surfaces, which are close to each other, of both said printing drum and said pressure drum rotate in a same direction, and a stencil printing is performed by pressing a print paper which is fed between said pressure drum and said stencil sheet placed on said surface of said printing drum by said pressure power; and wherein said power transfer means comprises a combined power means for receiving said driving power from a single driving power source in order to shift said inner press roller between said pressure position and said standby position and in order to adjust said pressure power of said inner press roller at said pressure position.

2. The stencil printing machine according to claim 1, wherein both said printing drum and said pressure drum have a same diameter.

3. The stencil printing machine according to claim 1, wherein the ink supply unit further comprises a roller member, wherein the roller member and a flanged cam surface of the printing drum cooperate to reduce a pressure applied to an inner surface of the printing drum in the area of a clamp section when in a pressure mode during printing.

4. A stencil printing machine comprising:

a printing drum and a pressure drum whose outer peripheral surfaces are close to each other and which are rotatable independently;

a stencil sheet attached on and removable from the outer peripheral surface of said printing drum;

an inner press roller arranged in an inner peripheral surface side of said printing drum, and which is shifted between a pressure position at which said inner press roller presses said inner peripheral surface of said printing drum, and a standby position at which said inner press roller is separated in position from said inner peripheral surface; and an inner press mechanism for adjusting a pressure power of said inner press roller at said pressure position, which comprises:

an ink supply unit arranged at inside of said printing drum for shifting said inner press roller between said pressure position and said standby position; and power transfer means arranged at outside of said printing drum, and for providing a driving power to said ink supply unit in order to shift said inner press roller between said pressure position and said standby position, and in order to adjust said pressure power of said inner press roller at said pressure position, wherein during printing, both said printing drum and said pressure drum are rotated so that said outer peripheral surfaces, which are close to each other, of both said printing drum and said pressure drum rotate in a same direction, and a stencil printing is performed by pressing a print paper which is fed between said pressure drum and said stencil sheet placed on said surface of said printing drum by said pressure power;

wherein said power transfer means comprises a combined power means for receiving said driving power from a single driving power source in order to shift said inner press roller between said pressure position and said standby position and in order to adjust said pressure power of said inner press roller at said pressure position; and wherein said combined power source has a link member and a spring for connecting said driving power source with said ink supply unit, and said link member transfers said driving power to said ink supply unit during a shift operation of said inner press roller from said pressure position to said standby position, and said spring transfers said driving power to said ink supply unit during a shift operation of said inner press roller from said standby position to said pressure position.

5. The stencil printing machine according to claim 4, wherein both said printing drum and said pressure drum have a same diameter.

6. The stencil printing machine according to claim 4, wherein the ink supply unit further comprises a roller member, wherein the roller member and a flanged cam surface of the printing drum cooperate to reduce a pressure applied to an inner surface of the printing drum in the area of a clamp section when in a pressure mode during printing.

7. A stencil printing machine comprising:

a printing drum and a pressure drum whose outer peripheral surfaces are close to each other and which are rotatable independently;

a stencil sheet attached on and removable from the outer peripheral surface of said printing drum;

an inner press roller arranged in an inner peripheral surface side of said printing drum, and which is shifted between a pressure position at which said inner press roller presses said inner peripheral surface of said printing drum, and a standby position at which said inner press roller is separated in position from said inner peripheral surface; and an inner press mechanism for adjusting a pressure power of said inner press roller at said pressure position, which comprises:

an ink supply unit arranged at inside of said printing drum for shifting said inner press roller between said pressure position and said standby position; and power transfer means arranged at outside of said printing drum, and for providing a driving power to said ink supply unit in order to shift said inner press roller between said pressure position and said standby position, and in order to adjust said pressure power of said inner press roller at said pressure position, wherein during printing, both said printing drum and said pressure drum are rotated so that said outer peripheral surfaces, which are close to each other, of both said printing drum and said pressure drum rotate in a same direction, and a stencil printing is performed by pressing a print paper which is fed between said pressure drum and said stencil sheet placed on said surface of said printing drum by said pressure power;

wherein said power transfer means comprises a combined power means for receiving said driving power from a single driving power source in order to shift said inner press roller between said pressure position and said standby position and in order to adjust said pressure power of said inner press roller at said pressure position; and wherein said single driving power source as said power transfer means is made up of a motor.

8. The stencil printing machine according to claim 7, wherein both said printing drum and said pressure drum have a same diameter.

9. The stencil printing machine according to claim 7, wherein the ink supply unit further comprises a roller member, wherein the roller member and a flanged cam surface of the printing drum cooperate to reduce a pressure applied to an inner surface of the printing drum in the area of a clamp section when in a pressure mode during printing.

* * * * *